United States Patent [19]

Boulais et al.

[11] 4,173,258

[45] Nov. 6, 1979

[54] LASER BEAM LEVEL CONTROL WITH AUTOMATIC OVERRIDE

[76] Inventors: Marcel J. Boulais, 5346 N. 91st Ave., Tolleson, Ariz. 85353; Richard A. Boulais, 10314 W. Montecito, Phoenix, Ariz. 85039

[21] Appl. No.: 861,101

[22] Filed: Dec. 16, 1977

[51] Int. Cl.[2] ..... A01B 63/111; A01B 63/112

[52] U.S. Cl. ..... 172/4.5; 172/12

[58] Field of Search ..... 172/2, 3, 4, 4.5, 7, 172/9, 11, 12; 37/DIG. 1, DIG. 20; 214/762, 763, 764; 404/84

[56] References Cited

U.S. PATENT DOCUMENTS

| | | | |
|---|---|---|---|
| 3,497,014 | 2/1970 | Ask | 172/4.5 |
| 3,887,012 | 6/1975 | Scholl et al. | 172/4.5 |
| 3,957,121 | 5/1976 | Takeda | 172/4.5 |
| 4,077,475 | 3/1978 | Hino et al. | 172/3 |

*Primary Examiner*—Richard T. Stouffer

[57] ABSTRACT

A laser beam level control system for an earth-moving machine is provided with an automatic override function to temporarily block blade-down signals and raise the blade when lowering it or leaving it at its previous height would increase the force required to drive the machine across the ground above a preselected value which does not exceed the tractional force capability of the machine's drive wheels or exceed the machine's available horsepower.

1 Claim, 7 Drawing Figures

LASER BEAM LEVEL CONTROL WITH AUTOMATIC OVERRIDE

This invention relates to a laser beam level control system for an earth-moving machine.

More particularly, the invention concerns a laser beam level control system with an automatic override function to prevent stalling the machine due to wheel slippage or due to lack of available horsepower.

In a further respect, the invention pertains to a laser beam level control system which automatically prevents the blade being positioned such that the force required to drive the machine across the terrain exceeds the tractional force capability of the drive wheels or tracks of the machine or exceeds the available horsepower of the motive engine.

In a further and still more specific respect, the invention pertains to such a laser beam level control system in which the force required to drive the machine across the terrain is electronically sensed and in which the amplified signal generated by the electronic sensor is compared with another signal of preselected strength to determine whether a countermanding signal should be applied to block a blade-down signal from the laser beam sensor system and generate a blade-up signal.

Laser beam level control systems for earth-working machines are known in the art. In general, such systems include a receiver for sensing a laser beam which is projected to define a reference plane. The receiver generates "blade-up" and "blade-down" command signals in response to the relative vertical displacement of the receiver sensor with respect to the reference plane established by the laser beam. Hydraulic and/or mechanical apparatus is provided to raise or lower the earth-moving blade of the machine to maintain the blade at a preselected elevation relative to the laser beam reference plane. Thus, as the earth-moving machine traverses terrain of variable elevation, the blade is automatically raised and lowered to provide a "finish" grade which is parallel to and located at a preselected vertical distance from the laser beam reference plane. Typical examples of such laser beam level control systems are disclosed in the patents to Studebaker U.S. Pat. No. 3,494,426; Rogers U.S. Pat. No. 3,554,291; Carter et al U.S. Pat. No. 3,604,512; Scholl U.S. Pat. No. 3,887,012 and Teach U.S. Pat. No. 3,953,145.

The prior art laser beam level control systems for earth-moving machines, described above, generally perform well under certain conditions, i.e., when the vertical contour of the terrain being graded does not vary abruptly, when the desired finish grade already approximates the actual ground contour and when the earth being worked is substantially uniform. When the original grade varies appreciably from the desired finish grade or when the earth being worked has spots as areas which are relatively much harder or softer than surrounding areas, a condition is frequently encountered in which the motive force required to drive the machine over the ground and move the blade through the earth is greater than the tractional force capabilities of the drive wheels or tracks of the machine (if self-powered) or exceeds the available horsepower of the tractor pulling it. Illustratively, if a tractor drawn scraper with a laser beam level control system encounters an abrupt rise in the terrain, the wheels of the machine will ride up on the "rise". This raises the level of the laser beam sensor, producing a "blade-down" command. When the blade is lowered, the force required to move the machine across the terrain is frequently increased to the point that the wheels of the machine or its tractor lose traction and start to spin or the load exceeds the available horsepower of the motive engine. Until now, the remedy for this situation was a manual override control which the operator could activate to attempt to prevent stalling or burying the whole of the machine. Most frequently the operator's reaction time is too slow and the machine either stalls or spins its drive wheels, necessitating raising the blade, or the operator attempts to remedy the situation by slipping the clutch connecting the drive wheels with the motive engine. In either instance, the resulting grade is very rough and, in the latter instance, slipping the clutch causes excessive wear of the clutch, transmission and tires leading to ultimate premature failure.

The principal object of the present invention is to provide an improved laser beam level control system for an earth-moving machine.

Yet another object of the invention is to provide such an improved system with an automatic blade-down override blocking function and which temporarily raises the blade until the force required to move the machine falls below a preselected value.

When the overload condition no longer exists, the automatic override returns the system to regular laser control operation.

Still another object of the invention is to provide such an improved system with an automatic override feature which results in greatly improved efficiency of the earth-moving machine in establishing the desired finish grade.

Another object of the invention is to provide an improved blade control system for earth-working machines which will operate with a smaller motive engine or tractor.

Yet another object of the invention is to provide an improved laser beam level control system for earth-working machines which functions to improve the life of the clutch and transmission connecting the drive wheels of the machine and the motive engine.

Still another object of the invention is to provide a laser beam level control system which simplifies the operator's tasks and reduces his mental and physical fatigue.

These, and other, further and more specific objects and advantages of the invention will be apparent to those skilled in the art from the following detailed description thereof, taken in conjunction with the drawings, in which.

Briefly, the present invention constitutes an improvement upon the prior art laser beam level control systems for earth-moving machines. Such prior art systems include a receiver for sensing a laser beam signal, which signal defines a reference plane. The receiver generates blade-up and blade-down command signals in response to the vertical displacement of the receiver with respect to the reference plane. The prior art systems also include blade operating means responsive to the blade command signals for raising and lowering the earth-moving blade of the machine to maintain the blade at a preselected elevation relative to the reference plane as the machine traverses terrain of variable elevation.

According to the improvements provided by the present invention, the control system automatically prevents the blade being positioned such that the force required to drive the machine across the terrain exceeds the tractional force capability of the ground contacting drive means of the machine or the available power of its motive engine. The automatic override capability is provided by means responsive to the motive force required to move the machine over the terrain for automatically generating an override signal when the force exceeds a preselected value which does not exceed the tractional force capability of the ground contacting drive means and means responsive to the automatic override signal which temporarily countermands a blade-down signal generated by the receiver means and applies a blade-up signal to the blade operating means. When overload condition no longer exists, the automatic override returns the system to regular laser control operation.

Figure 1:
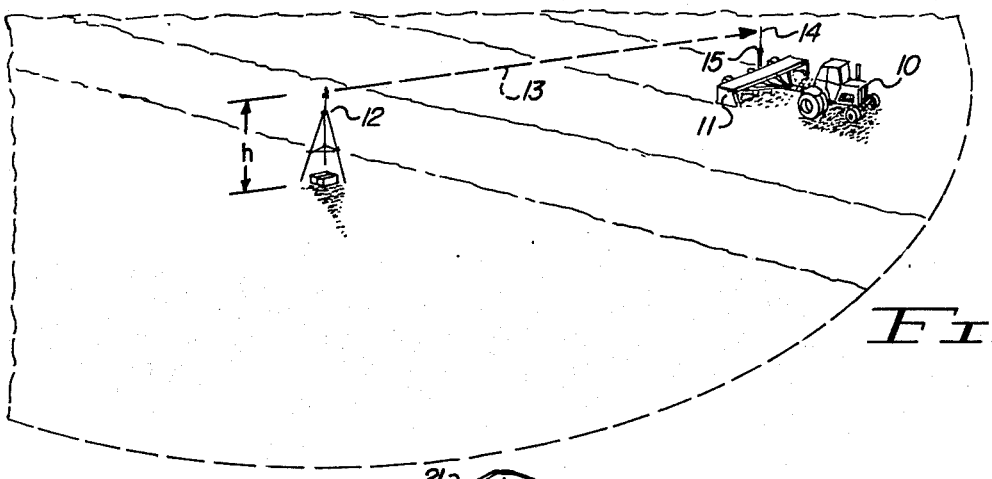
FIG. 1 is a perspective view illustrating the general mode of operation of laser beam level control systems for earth-moving machines.
Figure 2:
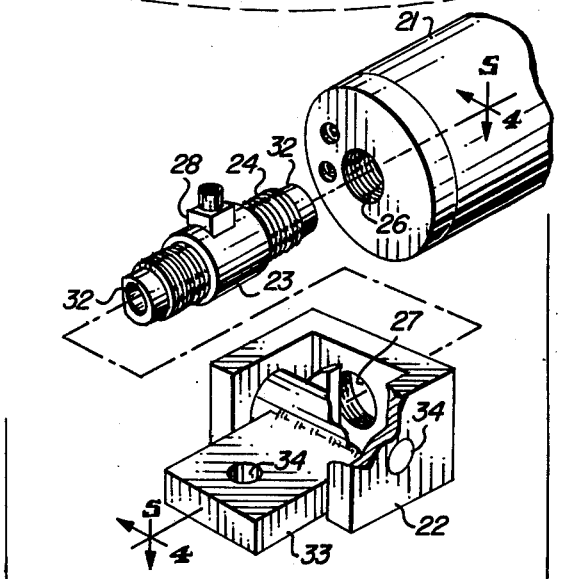
FIG. 2 is an exploded perspective view of a hitch system for a tractor drawn earth leveling machine, constructed in accordance with the presently preferred embodiment of the invention and including a force sensing element which activates the automatic override feature, described below.
Figure 3:
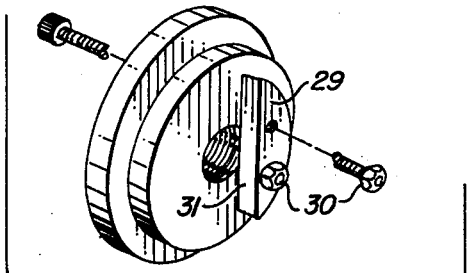
FIG. 3 is a perspective view of the threaded adapter which couples the load sensing element of FIG. 2 to the tubular hitch of the scraper.

Turning now to the drawings, FIG. 1 schematically depicts an earth-moving machine consisting of a tractor 10 to provide motive power drawing a leveling machine 11. A rotating laser 12 emits a beam 13 which establishes a reference plane, located a preselected distance H above the desired finished grade of the terrain. As the earth-working machine 10–11 encounters "high" and "low" spots in the terrain, the laser detector 14 mounted on a mast 15 carried on the leveling machine 11 is correspondingly raised and lowered above and below the reference plane 13. The detector 14, through receiver circuitry, generates "blade-up" and "blade-down" signals to cause the blade of the grading machine 11 to dig deeper when the machine encounters relatively higher terrain and to raise the blade and dig shallower or empty the bucket of the machine when the machine encounters relatively lower spots in the terrain.

According to the present invention, the force required to move the earth-working machine 11 over the terrain is sensed by a specially constructed hitch, shown in greater detail in FIGS. 2–5, in which like reference characters indicate the same parts in the several views. The hitch includes a tubular portion 21 forming the towing tongue of the scraper 11. The tubular portion 21 is joined to a clevis member 22 by a load cell 23. The load cell can be selected from any one of a number of standard commercially available types which utilize a piezoelectric element or Wheatstone bridge circuitry to generate an electrical signal which is proportional to the tensile forces acting on the sensing element. The load cell 23 is provided with threaded extensions 24 and 25 which engage the internal threads formed in the interior surfaces of the apertures 26 and 27 in the cylindrical extension 21 and in the clevis 22. The threaded extensions 25 and 24 are tightened into the threaded holes 26 and 27 and the load cell 23 is maintained in the upright position with the junction box 28 on top and is maintained in such position by means of locating members 29 secured by bolts 30, such that the flat side 31 of the locating member 29 bears against flat surfaces 32 formed on the sides of the cylindrical extensions 24 and 25 of the load cell 23.

The clevis 22 is provided with a tongue member 33 pivotally mounted on a pin 34 extending through the clevis 22. The tongue member 33 has a hole 34 to accommodate a pin (not shown), by means of which the assembly is affixed to the drawbar of the tractor 10.

Figure 6:
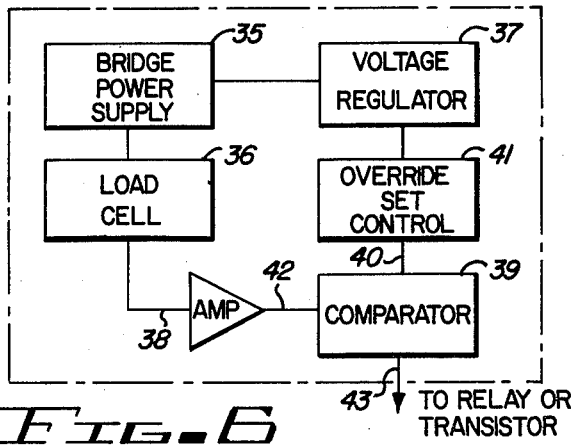
FIG. 6 is a block diagram illustrating the electronic means by which the automatic override signal is generated.
Figure 4:
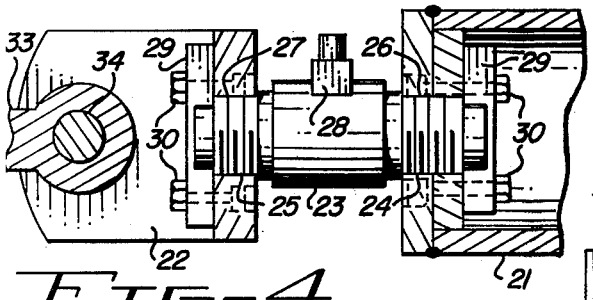
FIG. 4 is a sectional view of the hitch assembly of FIGS. 2-3 taken along section line 4—4 thereof.
Figure 5:
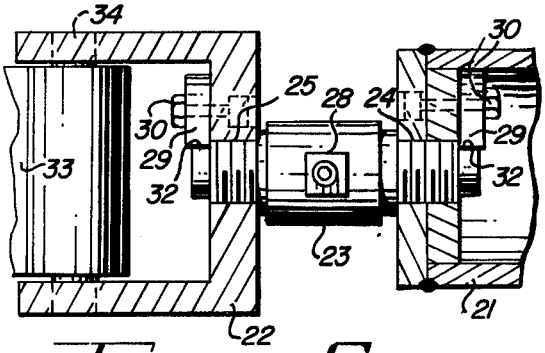
FIG. 5 is a sectional view of the hitch assembly of FIGS. 2-3 taken along section line 5—5 thereof.

As shown in FIG. 6, the output of a voltage regulator 37 is supplied both to the bridge power supply 35 and to an override set control 37. The output of the bridge power supply 35 constitutes the exciter voltage 35*a* of the load cell 36. The output 38 of the load cell is amplified and fed to a voltage comparator 39 where it is electronically compared with the output 40 of the override set control 41. When the amplified output 42 of the load cell 36 exceeds the output voltage of the override set control output 40, the comparator 39 emits a signal 43 which temporarily blocks any blade-down command generated by the conventional laser beam level control circuitry and initiates a blade-up signal as long as the overload condition exists. This prevents the blade being lowered and raises the blade to prevent stalling the earth-working machine, even though the laser beam level control system senses a rise in the terrain which would normally call for a deeper cut.

Figure 7:
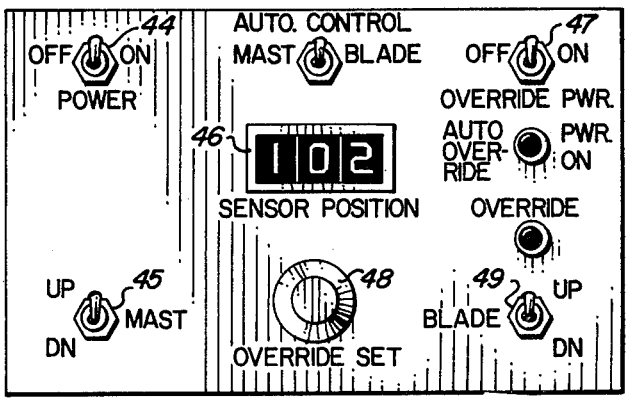
FIG. 7 illustrates a typical panel with the various controls which are utilized by the operator of an earth-moving machine incorporating the laser beam level control system with automatic override function, according to the presently preferred embodiment of the invention.

A typical control panel for use by the operator of machines incorporating the presently preferred embodiment of the invention is illustrated in FIG. 7. To operate the system, the operator turns the power switch 44 to the on position and adjusts the vertical height of the mast 15, carrying the laser detector 14 by manipulating the mast up-down switch 45 until the center portion of the detector intercepts laser beam 13. The detector position is indicated digitally by the readout 46. The operator then turns the override power switch 47 on and by making one or two practice runs, the operator determines the characteristics of the terrain and manipulates the override set control 48 to provide the proper override set control voltage output 40. Ideally, the control is adjusted to the point that the comparator 39 emits an override signal 43 just before the force required to move the machine over the terrain causes the drive wheels of the machine to lose traction and slip. A manual blade up-down switch 49 is provided for use when required.

It is to be emphasized that the particular apparatus depicted in FIGS. 2–7 constitutes only one presently preferred way of sensing the force required to move the earth-working machine across the terrain and various alternative methods for sensing this force and generating appropriate override signals will readily occur to those skills in the art, having regard for the disclosure hereof. For example, the motive force required to move the earth-working machine across the terrain could be sensed by piezoelectric elements measuring the force applied directly to the blade of the earth-working machine, the sensors could be built into the drawbar of the tractor 10, or the force could be sensed hydraulically at a number of points in the machine.

Having described the invention in such terms as to enable those skilled in the art to understand and practice it, and having identified the presently preferred embodiments thereof, we claim:

1. In a laser beam level control system for an earth-moving machine having a variable height earth-moving blade, ground-contacting drive means and a motive engine, said level control system including receiver means for sensing a laser beam signal, which signal defines a reference plane, and for generating blade-up and blade-down command signals in response to the vertical displacement of said receiver means with respect to said reference plane, and blade operating means responsive to said blade command signals for raising and lowering the earth-moving blade of said machine to maintain the blade at a preselected elevation relative to said reference plane as said machine traverses terrain of variable elevation, the improvement in said control system which automatically prevents said blade being positioned such that the force required to drive said machine across said terrain exceeds the tractional force capability of said drive means or the available power of said motive engine, said improvement comprising:

(a) means responsive to the force required to move said blade through said terrain, for automatically generating an override signal when said force exceeds a preselected value which does not exceed the tractional force capability of said ground-contacting drive means or the available horsepower of said motive engine;

(b) means responsive to said automatic override signal which temporarily countermands a blade-down signal generated by said receiver means and applies a blade-up signal to said blade operating means; and (c) means to maintain said override signal as long as said force exceeds said preselected value and to return said blade to control by said laser beam signal as soon as said force no longer exceeds said preselected value.

* * * * *